US006158085A

United States Patent [19]

Oshiro

[11] Patent Number: 6,158,085

[45] Date of Patent: Dec. 12, 2000

[54] CLOSING DEVICE FOR ORIGINAL COVER

[75] Inventor: Kazuhiko Oshiro, Kanagawa, Japan

[73] Assignee: Katoh Electrical Machinery Co., Ltd., Japan

[21] Appl. No.: 09/076,536

[22] Filed: May 12, 1998

[30] Foreign Application Priority Data

May 15, 1997 [JP] Japan ..... 9-125889

[51] Int. Cl.[7] ..... E05F 1/08

[52] U.S. Cl. ..... 16/72; 16/303; 16/341

[58] Field of Search ..... 16/72, 341, 303

[56] References Cited

U.S. PATENT DOCUMENTS

| | | | |
|---|---|---|---|
| 3,401,422 | 9/1968 | Ventura . | |
| 4,000,540 | 1/1977 | Newlon | 16/151 |
| 4,424,606 | 1/1984 | Sorimachi | 16/223 |
| 4,658,473 | 4/1987 | Schema | 16/290 |
| 5,628,089 | 5/1997 | Wilcox et al. | 16/303 |

*Primary Examiner*—Anthony Knight
*Assistant Examiner*—Alison K. Pickard
*Attorney, Agent, or Firm*—Notaro & Michalos P.C.

[57] ABSTRACT

In order to provide a closing device for an original cover in which a spring case is not cracked or broken during use even if zircon by which the spring case can be cheaply manufactured and which has excellent mechanical characteristics is especially used, the closing device has the spring case made of a synthetic resin provided for either an attaching member attached to a machine body or a supporting member for holding the original cover rotatably connected to the attaching member via a hinge pin and the rotation moment of the original cover attached to the supporting member is controlled by using a compression force of a compression coil spring housed in the spring case, wherein a reinforcing frame member made of a metal for reinforcing the spring case is attached to the spring case.

3 Claims, 9 Drawing Sheets

CLOSING DEVICE FOR ORIGINAL COVER

BACKGROUND OF THE INVENTION

1. Field of the Invention

The present invention relates to an original cover closing device employed for closing an original cover for use in a copy machine, a printing machine, or the like.

2. Related Art

In recent years, moldings of synthetic resins (plastic) are used as parts in every industrial machinery. The synthetic resins have so-called creep characteristics such that (1) when a predetermined force is continuously applied, deformation is advanced with elapse of time, and even if the force is stopped, the molding is not returned to the original state, (2) when a predetermined deformation occurs continuously, its repulsion is decreased with elapse of time, and (3) when time is further elapsed, the molding is destroyed. Among the synthetic resins, since zircon (polyacetal copolymer) has excellent mechanical characteristics including a creep resistance characteristic, it is used in various fields.

Consequently, zircon is also used for an original cover closing device. The following device using zircon is known.

There is an original cover closing device comprising: a supporting member made of zircon attached to the device body side; a spring case provided integrally with the supporting member; a slider housed in the spring case slidably to a cam part; and compression means constructed by a compression spring compressedly provided between the slider and the bottom of the spring case so as to press the slider to the cam side.

The attaching member and the supporting member made of zircon can be produced cheaper than those produced by press working iron plates and have an advantage that the members can be made in various forms. Although zircon has a high creep resistance characteristic among synthetic resins, when the members are used for many years, the following problems occur. A crack occurs especially on the bottom of the spring case and the bottom is fell out. The spring case is broken when a force is applied and broken pieces spread, and the like.

SUMMARY OF THE INVENTION

It is an object of the invention to provide a closing device for an original cover, in which a spring case is not cracked or broken during use even when zircon by which especially the spring case can be cheaply manufactured and which has excellent mechanical characteristics is used.

In order to achieve the object, according to the invention, there is provided a closing device for an original cover, comprising a spring case made of a synthetic resin provided for either an attaching member attached to a machine body or a supporting member for holding an original cover rotatably connected to the attaching member via a hinge pin, and for controlling the rotation moment of the original cover attached to the supporting member by using the compression force of compression coil springs housed in the spring case, wherein a reinforcing frame member made of a metal for reinforcing the spring case which consists of a base plate portion for covering a bottom portion of the spring case, side plate portions bent from both ends of the base plate portion into a direction away from a plane of the base plate portion for covering both side portions of the spring case, and attaching holes opened at the side plate portions for connecting to the hinge pin. Thus, the reinforcing frame member is fastened to the spring case by inserting the hinge pin into the attaching holes.

According to the invention, there is also provided a closing device of an original cover, characterized by comprising: an attaching member attached to a machine body; a cam part mounted on the attaching member; a supporting member made of a synthetic resin which faces the cam part and supports an original cover rotatably connected to the attaching member via a hinge pin; a spring case made of a synthetic resin integrally formed with the supporting member and having a bottom portion and both side portions; a slider housed in the spring case slidably toward the cam part; a compression spring compressedly provided between the slider and the bottom of the spring case in order to press the slider toward the cam part; and a reinforcing frame member made of a metal for reinforcing the spring case and consisting of a base plate portion for covering a bottom portion of the spring case, side plate portions bent from both ends of the base plate portion into a direction away from a plane of the base plane portion for covering both side portions of the spring case, and attaching holes opened at the side plate portions for connecting to the hinge pin. Thus, the reinforcing frame member is fastened to the spring case by inserting the hine pin to the attaching holes.

According to the invention, there is further provided a closing device of an original cover, characterized by comprising: an attaching member serving as a leg to be attached to a machine body, provided in an upper part of a spring case made of a synthetic resin; a supporting member for supporting an original cover rotatably connected to the attaching member via a hinge pin; a cam part provided for the supporting member; a slider slidably housed in the spring case so as to face the cam part; a compression spring compressedly provided between the slider and the spring case in order to energize the slider to slide toward the cam part; and a reinforcing frame member made of a metal for reinforcing the spring case and consisting a base plate portion for covering a bottom portion of said spring case, side plate portions bent from both ends of the base plate portion into a direction away from a plane of the base plate portion for covering both side portions of the spring case, and attaching holes opened at the side plate portions for connecting to the hinge pin. Thus, the reinforcing frame member is fastened to the spring case by inserting the hinge pin to the attaching holes.

Other and further objects, features and advantages of the invention will appear more fully from the following description

DETAILED DESCRIPTION OF THE PREFERRED EMBODIMENTS

Figure 1:
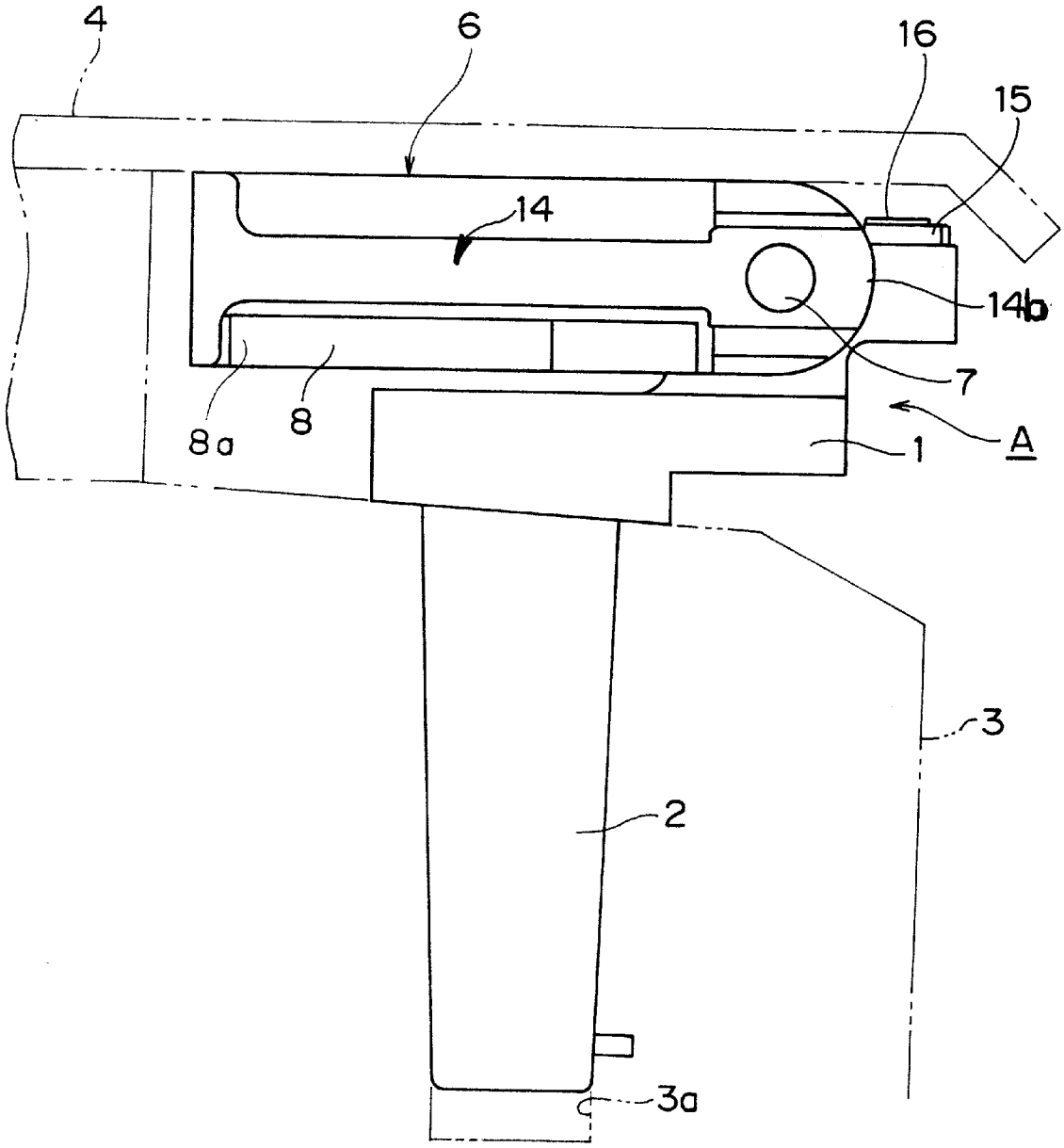
FIG. 1 is a side view of an original cover closing device according to the invention.
Figure 2:
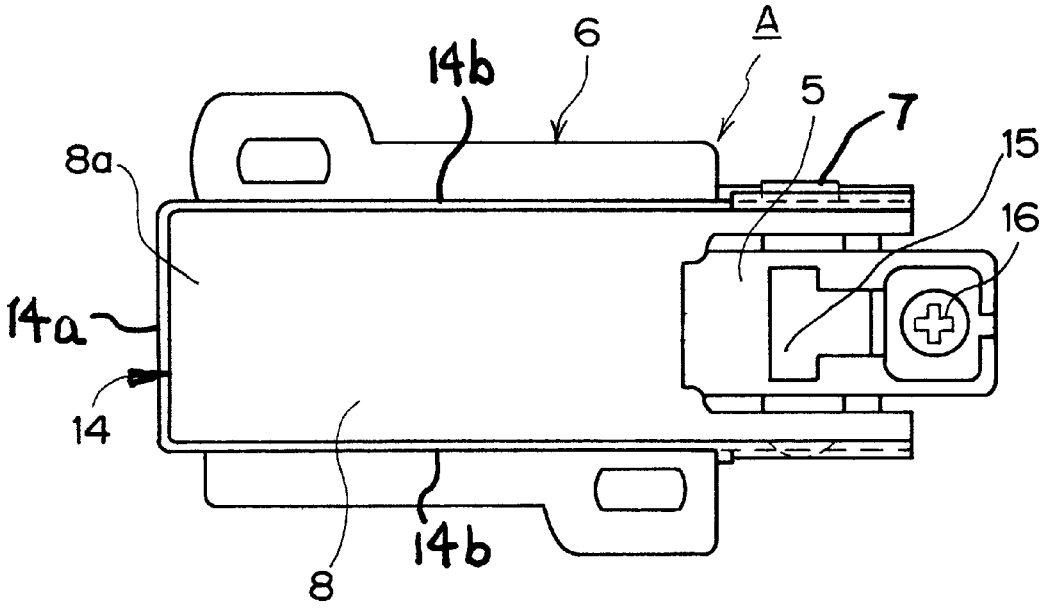
FIG. 2 is a plan view of the original cover closing device shown in FIG. 1.

The following drawings show an embodiment of an original cover closing device A according to the invention. In FIGS. 1 to 5, reference numeral 1 denotes an attaching member having a leg 2. By detachably inserting the leg 2 into an insertion hole 3*a* opened in a rear upper end of the body of, for example, a copy machine shown by imaginary lines, the closing device is mounted on the machine body 3. Although a use example of the leg 2 is not shown in the diagram, for example, when an original is a thick original such as a book, by lifting the position of the insertion hole 3*a* to allow an original cover 4 shown by imaginary lines to cover the top face of the thick original in a horizontal state, it can be prevented as much as possible that external light enters an optical system of the machine body 3 and that internal light leaks to the outside. The attaching member 1 including the leg 2 are formed of a synthetic resin such as zircon and a cam part 5 is integrally formed on the attaching member 1.

Reference numeral 6 denotes a supporting member for supporting the original cover 4 having one end rotatably connected to the attaching member 1 via a hinge pin 7. The supporting member 6 is made of a synthetic resin such as zircon in a manner similar to the attaching member 1 and is formed integrally with a spring case 8 in a position facing the cam part 5. In the spring case 8, a slider 9 is slidably housed and a lever pin 10 attached to an end of the slider 9 comes into contact with the cam part 5. Compression means 13 comprising small and large coil springs 11 and 12 are compressedly provided between the slider 9 and the inner side of the bottom 8*a* of the spring case 8 to thereby always press the slider 9 to the cam part 5 side.

Figure 5:
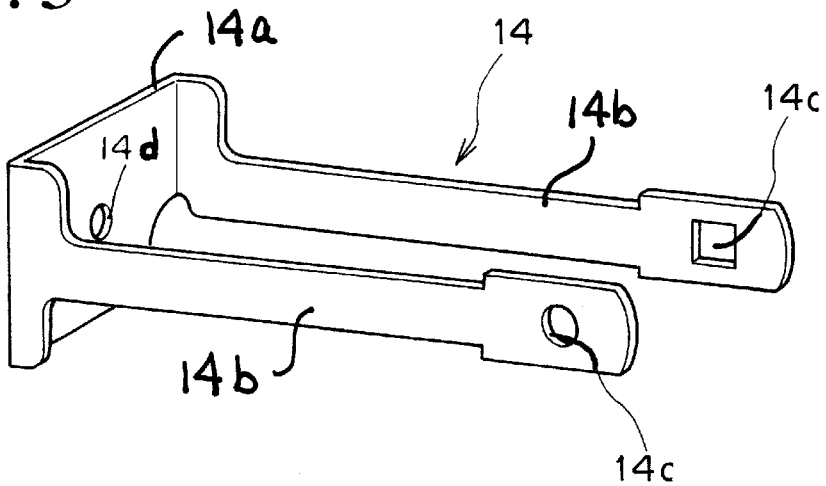
FIG. 5 is a perspective view of a reinforcing frame member.

A reinforcing frame member 14 having an almost U- letter shape in cross section especially shown in FIG. 5 is attached to the outside of the spring case 8 so as to cover the outside of the bottom 8*a*. are coupled to the hinge pin 7. The reinforcing frame member 14 is made of a base plate portion 14*a*, side plate portions 14*b*, 14*b* bent from both ends of the base plate portion 14*a* to a direction away from a plane of the base plate portion and attaching holes 14*c*, 14*c* are opened in each end portions of the side plate portions 14*b*, 14*b*. In the member 14, a part which is in contact with the bottom 8*a* of the spring case 8 is made wider than the other parts to be adapted to a shape of the bottom 8*a* so as to cover the bottom 8*a*, an attaching hole 14*d*. The side plate portions 14*b*, 14*b* are fit on both side portions 8*c*, 8*c* of the spring case 8 and fastened or coupled to the hinge pin 7 by inserting the hinge pin 7 to the attaching holes 14*c*, 14*c*. A vis can be also used for this part.

Figure 3:
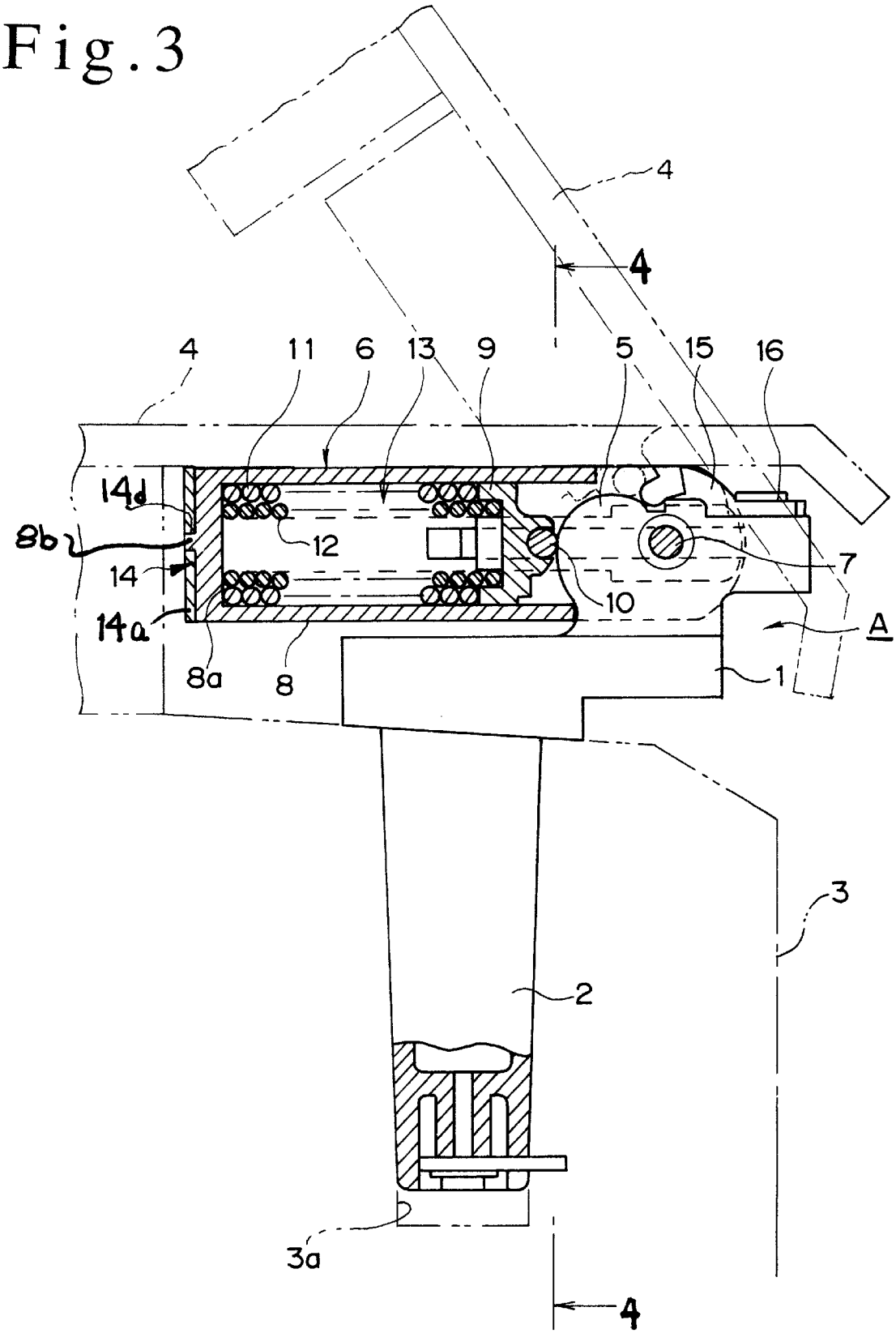
FIG. 3 is a side view of a partial cross section of the original cover closing device shown in FIG. 1.
Figure 4:
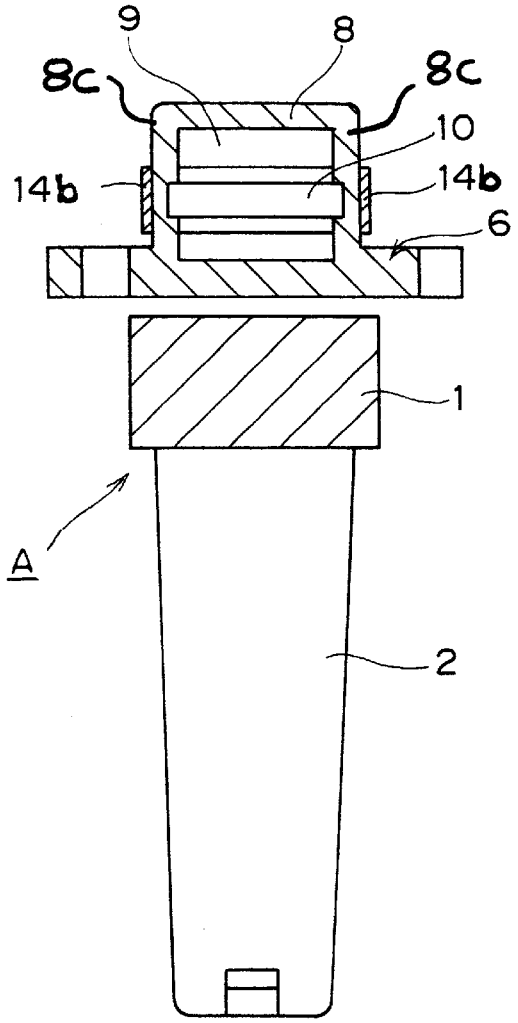
FIG. 4 is a cross section taken on line 4—4 of the original cover closing device shown in FIG. 3.

The original cover closing device A according to the embodiment can be used by attaching the rear end of the original cover 4 to the supporting member 6 and by inserting the leg 2 of the attaching member 1 into the insertion hole 3*a* opened in the upper rear end of the machine body 3 as shown by imaginary lines in FIGS. 1 and 3. When the original cover 4 is opened/closed, the supporting member 6 rotates around the cam part 5 by using the hinge pin 7 as a fulcrum. Simultaneously, by a cooperative action of the cam part 5 and the slider 9 sliding on the circumferential face of the cam part 5 in a pressure contacting state, the original cover 4 is stably stopped and held at an intermediate open angle and is not naturally closed. As shown by the imaginary lines in FIG. 3, the original cover 4 is opened until the lever pin 10 of the slider 9 comes into contact with a stopper member 15.

When the original cover 4 is closed, the slider 9 which is in press contact with the cam part 5 slides in the direction of compressing the compression means 13. By the repulsion of the compression means 13, although the original cover 4 is not suddenly closed, the original cover 4 is energized in the closing direction. Consequently, the closing state of the original cover 4 is stable and occurrence of so-called a floating phenomenon which tends to occur when such compression means 13 is used can be prevented. The problem of the crack, coming off, and the like which tends to occur with long time of use on the bottom 8*a* of the spring case 8 is solved by reinforcing the spring case 8 by the reinforcing frame member 14 covering the outside of the bottom.

FIGS. 6 to 10 show another embodiment of the invention. In an original cover closing device B according to the embodiment, as an attaching member 21 is especially shown in FIGS. 6 and 8, for example, the leg attached to a machine body 22 side also serves as a spring case 23. A slider 24 is slidably housed in the spring case 23 and compression means 27 constructed by small and large coil springs 25 and 26 is compressedly provided between the slider 24 and the inner bottom of the bottom part 23*a* of the spring case 23.

Reference numeral 28 denotes a supporting member which is rotatably connected to the upper part of the attaching member 21 by a hinge pin 29. The supporting member 28 has a cam part 30 and the cam part 30 is in press contact with the slider 24. Reference numeral 35 is a lever pin which is actually in press contact with the cam part 30.

Figure 6:
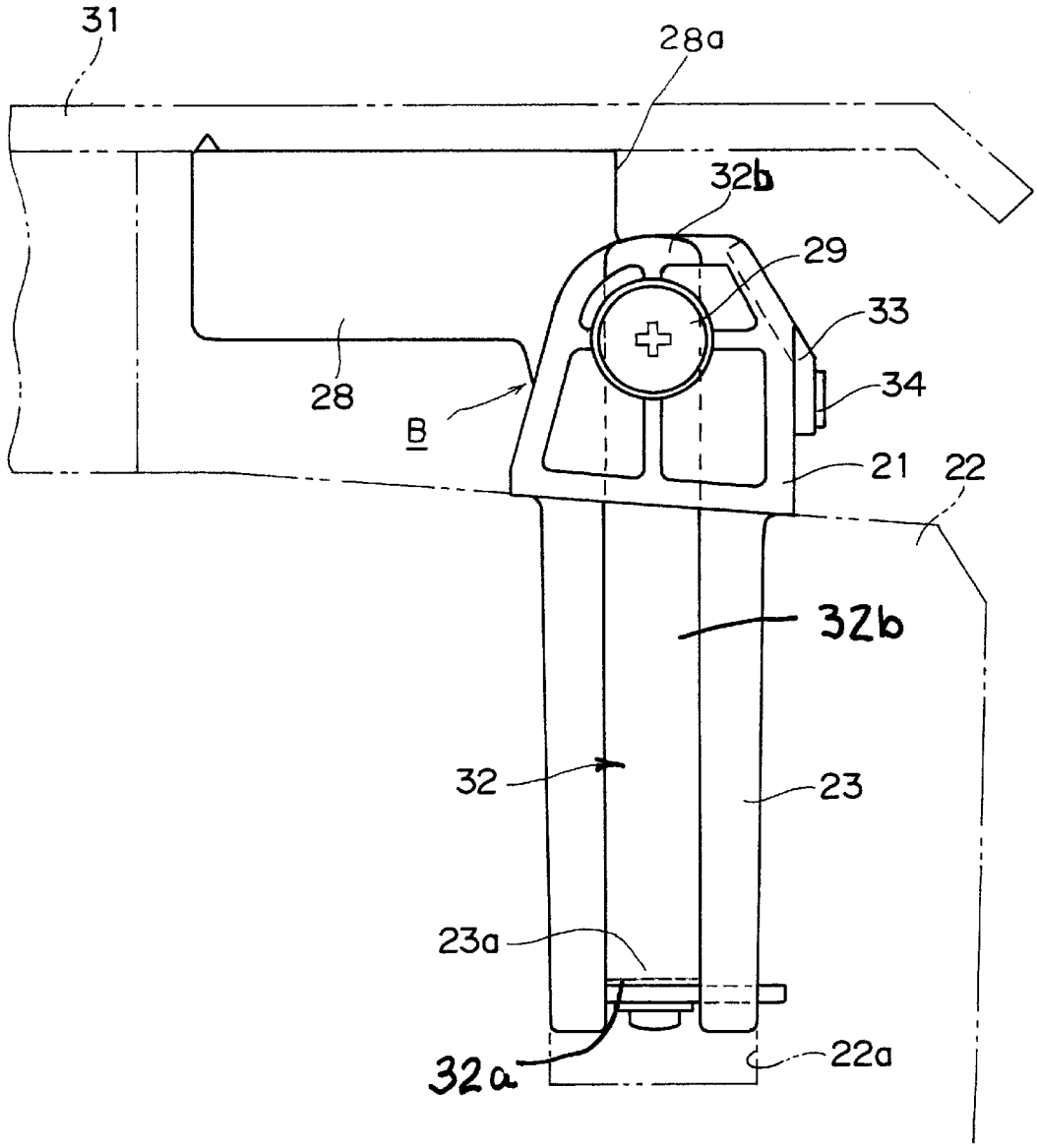
FIG. 6 is a side view showing another embodiment of the original cover closing device according to the invention.
Figure 7:
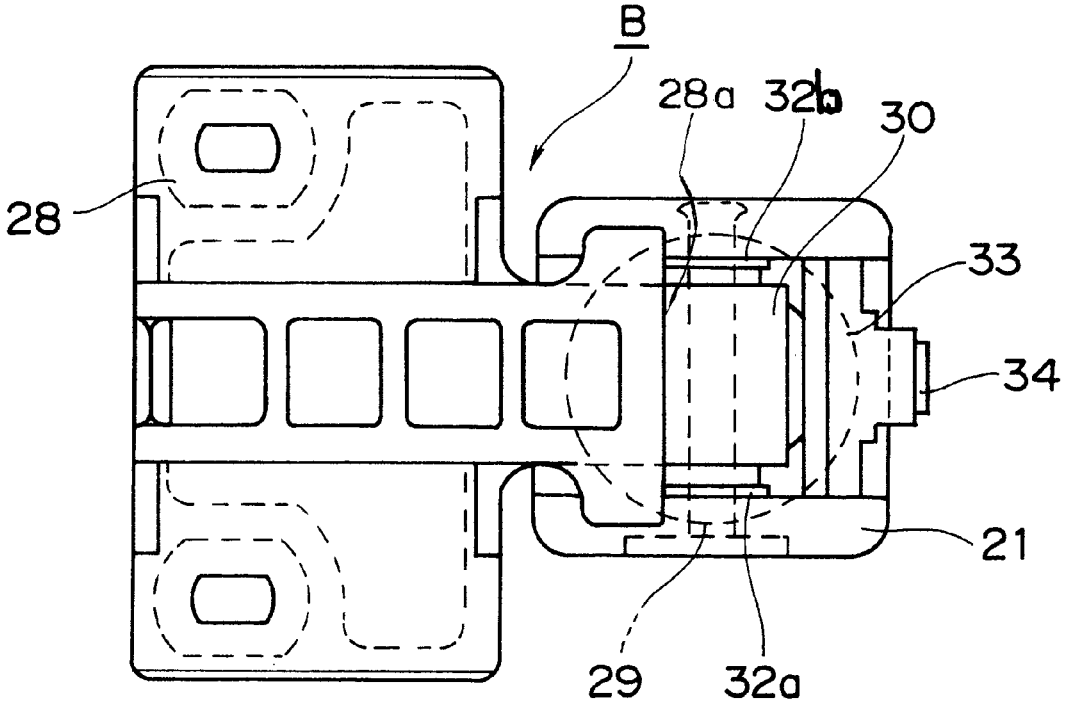
FIG. 7 is a plan view of the original cover closing device shown in FIG. 6.
Figure 8:
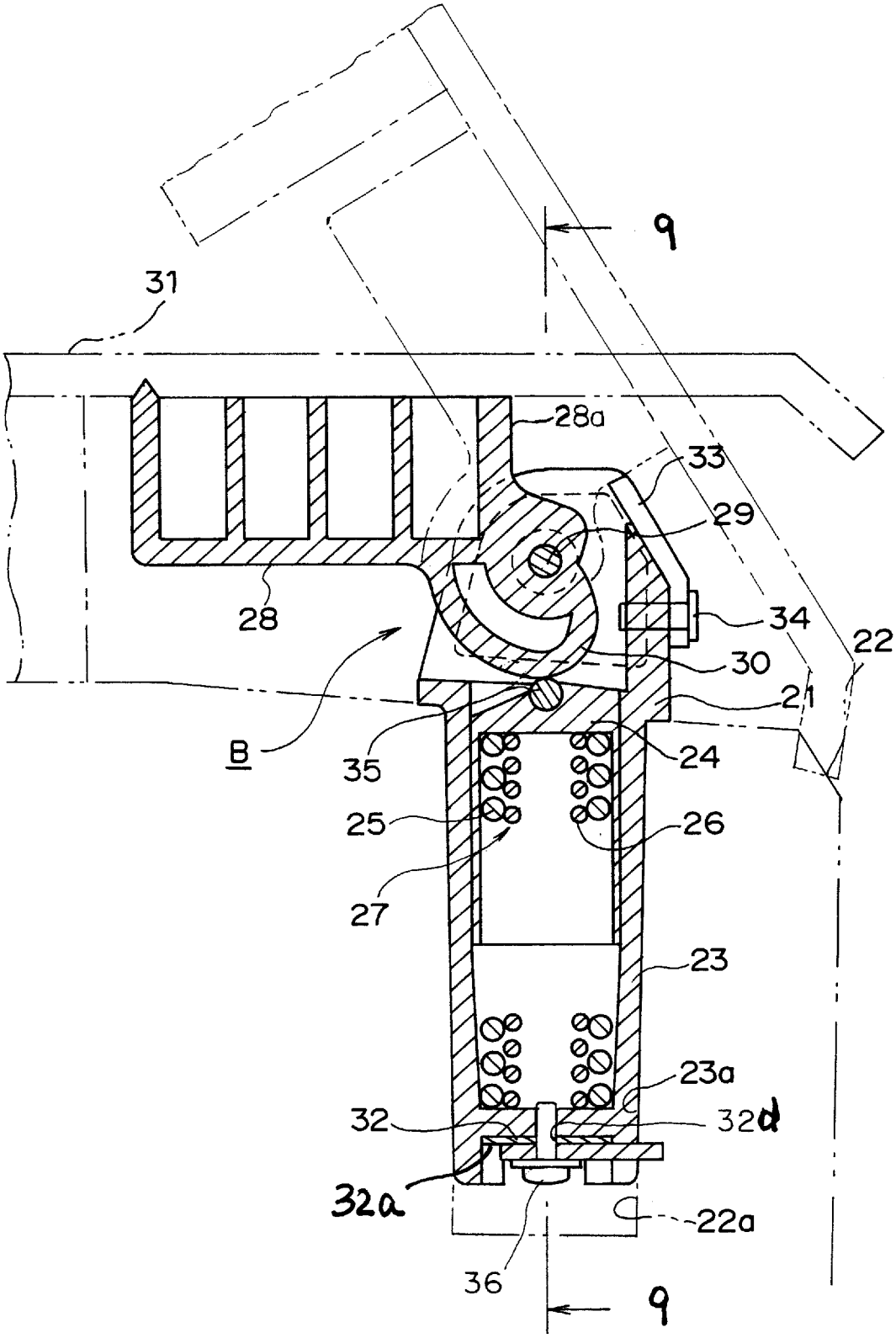
FIG. 8 is a sectional side view of the original cover closing device shown in FIG. 6.
Figure 9:
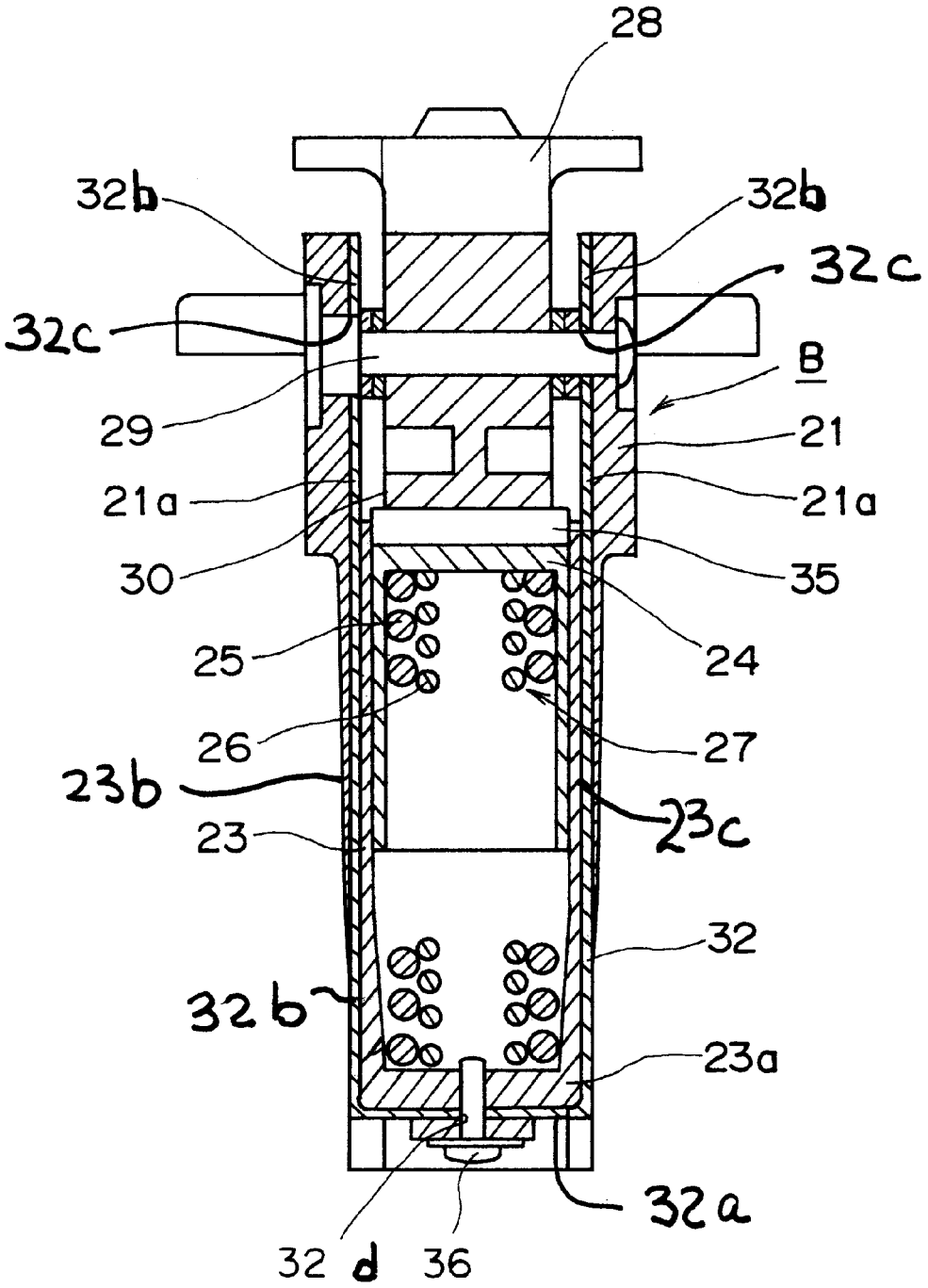
FIG. 9 is a cross section taken along line 9—9 of the original cover closing device shown in FIG. 8.
Figure 10:
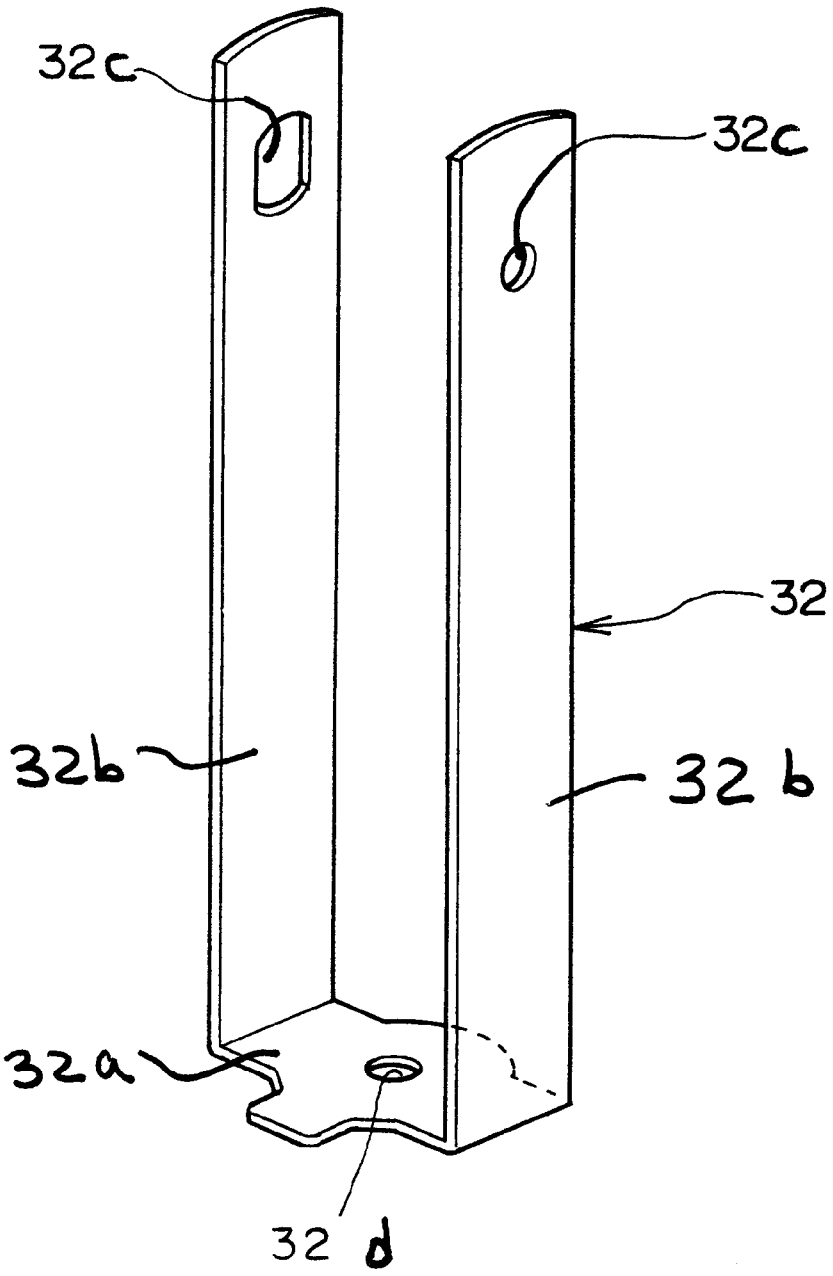
FIG. 10 is a perspective view of another embodiment of the reinforcing frame member.

In the original cover closing device B according to the embodiment, as shown in FIGS. 6 to 8, the rear end of an original cover 31 shown by imaginary lines is attached to the supporting member 28 and a reinforcing frame member 32 having an almost U-letter shape in cross section is fit to the outside of the spring case 23 so as to cover the bottom 23*a*. The reinforcing frame member 32 is made of, for example, stainless steel. The reinforcing frame member 32 is made from a base plate portion 32*a*, side plate portions 32*b*, 32*b* bent from both ends of the base plate portion 32*a* to a direction away from a plane of the base plate portion, attaching holes 32*c*, 32*c* are opened in each end portions of the side plate portions 32*b*, 32*b*, and an attaching hole 32*d* is opened in a part covering the bottom portion 23*a*.

Both side plate portions 32*b*, 32*b* of the reinforcing frame member 32 are inserted into insertion holes 23*c*, 23*c* opened on both side portions 23*b*, 23*b* of the spring case 23. The base plate portion 32 fixed to bottom portion 23*a* of the spring case 23 by an attaching vis 36 through the attaching hole 32*d*. The side plate portions 32*b*, 32*b* is fit on side portions 23*b*, 23*b* of the spring case 23 and fastened or coupled to the hinge pin 29 by inserting the hinge pin 29 to the attaching holes 32*c*, 32*c*.

When the original cover 31 is opened, the supporting member 28 rotates around the hinge pin 29 as a fulcrum and the original cover 31 is stably stopped and held at an intermediate open angle by a cooperative action of the cam 30 and the slider 24 which slides in a press contact state to the cam part 30. The end 28*a* of the supporting member 28 comes into contact with a stopper member 33 attached to the upper part of the attaching member 21 by an attaching vis 34, thereby regulating the maximum open angle of the original cover 31.

In case of closing the original cover 31 as well, the original cover 31 is not suddenly closed by the cooperative action of the cam part 30 and the slider 24. The crack and breakage occurring on the bottom of the spring case 28 by the compression member 27 which repeats expansion and contraction with repetition of the opening/closing operation of the original cover 31 is prevented by the reinforcing frame member 32.

Having described our inventions as related to the embodiment shown in the accompanying drawing, it is our intention that the invention be not limited by any of the details of description, unless otherwise specified, but rather be construed broadly within its spirit and scope as set out in the accompanying claims.

I claim:

1. A closing device for an original cover, comprising a spring case having a bottom portion and opposite side portions and made of a synthetic resin provided for either an attaching member attached to a machine body or a supporting member for holding an original cover rotatably connected to the attaching member via a hinge pin, for controlling a rotation moment of the original cover attached to said supporting member by using a compression force of compression coil springs housed in the spring case, wherein a reinforcing frame member made of a metal for reinforcing said spring case comprises a base plate portion for covering the bottom portion of said spring case and having opposite ends, side plate portions bent from both opposite ends of said base plate portion to a direction away from a plane of the base plate portion for covering the opposite side portions of said spring case, and attaching holes opened at said side plate portions for connecting to said hinge pin, so that said reinforcing frame member is fastened to said spring case by inserting said hinge pin to said attaching holes.

2. A closing device for an original cover, comprising: an attaching member attached to a machine body; a cam part mounted on the attaching member; a supporting member made of a synthetic resin which faces the cam part and supports an original cover rotatably connected to said attaching member via a hinge pin; a spring case made of a synthetic resin integrally formed with the supporting member and having a bottom portion and opposite side portions; a slider housed in the spring case so as to be slidable toward said cam part; a compression spring compressedly provided between the slider and the bottom of said spring case in order to press said slider toward said cam part; and a reinforcing frame member made of a metal for reinforcing said spring case and comprising a base plate portion for covering the bottom portion of said spring case and having opposite ends, side plate portions bent from both opposite ends of said base plate portion to a direction away from a plane of the base plate portion for covering the opposite side portions of said spring case, and attaching holes opened at said side plate portions for connecting to said hinge pin, so that said reinforcing frame member is fastened to said spring case by inserting said hinge pin to said attaching holes.

3. A closing device for an original cover, comprising: an attaching member attached to an upper part of a spring case having a bottom portion and opposite side portions and made of a synthetic resin also serving as a leg attached to a machine body; a supporting member for supporting an original cover rotatably connected to said attaching member via a hinge pin; a cam part provided for the supporting member; a slider slidably housed in said spring case so as to face the cam part; a compression spring compressedly provided between the slider and said spring case in order to energize said slider to slide toward said cam part; and a reinforcing frame member made of a metal for reinforcing said spring case and comprises a base plate portion for covering the bottom portion of said spring case, side plate portions bent from opposite ends of said base plate portion to a direction away from a plane of the base plate portion for covering the opposite side portions of said spring case, and attaching holes opened at said side plate portions for connecting to said hinge pin, so that said reinforcing frame member is fastened to said spring case by inserting said hinge pin to said attaching holes.

* * * * *